United States Patent [19]

Brandenberger

[11] Patent Number: 4,569,091

[45] Date of Patent: Feb. 11, 1986

[54] BOOM ARM OR CANTILEVER ARRANGEMENT FOR SWIVELLING ELEVATOR BODY SUPPORT

[75] Inventor: Kurt Brandenberger, Schwimmbadweg 15, 4144 Arlesheim, Switzerland

[73] Assignee: Kurt Brandenberger, Arlesheim, Switzerland

[21] Appl. No.: 581,781

[22] Filed: Feb. 21, 1984

[30] Foreign Application Priority Data

Mar. 3, 1983 [CH] Switzerland ..... 1154/83

[51] Int. Cl.[4] ..... A47K 3/12

[52] U.S. Cl. ..... 4/562; 4/563; 403/116; 403/391

[58] Field of Search ..... 4/560–566, 4/578, 579; 5/81 R, 81 B, 85; 403/389, 391, 400, 116, 113

[56] References Cited

U.S. PATENT DOCUMENTS

| | | | |
|---|---|---|---|
| 870,910 | 11/1907 | Splittgerber | 403/116 X |
| 2,788,055 | 4/1957 | Tumas | 4/565 |
| 3,371,357 | 3/1968 | Berthelsen et al. . | |
| 3,574,364 | 4/1971 | Langren et al. . | |
| 3,612,042 | 10/1971 | Fry | 5/81 B |
| 3,945,291 | 3/1976 | Zickos | 403/391 X |
| 4,003,479 | 1/1977 | Reyer . | |
| 4,075,719 | 2/1978 | Sullivan . | |

FOREIGN PATENT DOCUMENTS

| | | | |
|---|---|---|---|
| 1068083 | 6/1954 | France | 403/391 |
| 2117822 | 10/1983 | United Kingdom | 403/DIG. 9 |
| 2123285 | 2/1984 | United Kingdom | 4/563 |

*Primary Examiner*—Charles E. Phillips

*Attorney, Agent, or Firm*—Werner W. Kleeman

[57] ABSTRACT

Standard engineering shapes or profile elements are united by screw clamps to form a releasable and adjustable boom arm or cantilever arrangement. By means of quadrangular clamp bodies, substantially vertical support arms carrying seating or reclining means for a person are mounted on a horizontal support arm and can be individually adjusted in relation thereto. The boom arm is mounted in a further screw clamp provided in the free end of a hydraulic cylinder and piston assembly and is therefore capable of being raised and lowered and swivelled about the lengthwise axis of the cylinder. A hand-grip capable of being pivoted away is provided for the safety of the occupant. Boom arms of this type are employed in bathing installations to safely transport patients and invalids into and out of bath or the like tubs. The releasable and adjustable design concept of the boom arm permits it to be dimensionally adjusted during its initial installation, so that preliminary dimensional surveys are superfluous. In service, the boom arm can be readily adapted to modifications of building or apparatus, changed methods of treatment and varying ergonomic requirements. This provides an increased degree of flexibility and adaptability in application in comparison to welded constructions and therefore greater economy.

10 Claims, 3 Drawing Figures

BOOM ARM OR CANTILEVER ARRANGEMENT FOR SWIVELLING ELEVATOR BODY SUPPORT

BACKGROUND OF THE INVENTION

The present invention relates to a boom arm or cantilever arrangement for swivelling elevator seating and reclining devices, such as bath tub seats and the like, comprising a substantially horizontally cantilevered support arm mounted on or in a swivelling elevator device and in which substantially vertical support arms for accommodating body support means, such as a seat or a reclining couch, are provided. The vertical support arms are adjustably fixable in clamping blocks which are, in turn, adjustably fixable on the boom arm.

Such swivelling elevator seat and reclining devices serve to transport, support and position patients and invalids and are commonly employed in installations for the rational care of patients. In bathing installations they permit the safe and comfortable transport of patients into and out of bath tubs adapted to the ergonomic requirements of nursing and therapy personnel and therefore not accessible to handicapped persons or invalids without assistance. Such bathtubs have differing widths and heights and also differ in the slope of their narrow ends.

Swivelling elevator seats of the type described are already known in which the boom arm or cantilever arrangement is welded up as a custom-tailored product from tubular and profiled components. The individual components are, for instance, mounted in templates and rigidly assembled in mutual relationship by welding.

Such means of construction are work-intensive and subject to the known disadvantages of welding technology. First a survey of the measurements required for each individual installation must be taken in detail and with great accuracy, since, due to the welded construction, a subsequent adaptation, for instance at installation time, is impossible or can only be done with the greatest difficulty. Qualified personnel well acquainted with the installation are therefore required for this survey. Furthermore, the investment in tooling and work for the dimensionally accurate welded construction of such a boom arm is considerable so that one can hardly speak of quick and economic assembly. In spite of this considerable effort, dimensional agreement between the boom arm and the bathing installation is not sufficiently certain. This is because a boom arm is a rigid integral unit and errors in the initial dimensional survey cannot be corrected later. Warping or deformation of the structure caused by thermal stresses cannot always be fully corrected by cold or hot forming adjustments. In either case there is no alternative but to replace the faulty boom arm with a new assembly.

In boom arms of this type, structural components are required having different shapes and dimensions for each installation. The employment of mass-produced components that could be used for a wide range of installations in the form of identical standard parts is in general impossible. This makes the boom arm more expensive and the provision of replacement parts problematic.

A further disadvantage of such welded constructions is the fact that they are custom-tailored and therefore cannot be used for different bathtubs having different heights and widths. It is therefore impossible to adapt them to new conditions when a bathtub is replaced or other constructional changes are made. There is also no opportunity for quickly and easily replacing components subject to rapid wear.

SUMMARY OF THE INVENTION

Therefore, with the foregoing in mind it is a primary object of the present invention to provide a new and improved construction of a swivelling elevator boom arm or cantilever arrangement which does not have associated with it the aforementioned drawbacks and shortcomings of the prior art constructions.

Another and more specific object of the present invention aims at providing a new and improved construction of a swivelling elevator boom arm or cantilever arrangement for seating or reclining supports, such as bathtub seats or body supports, of the previously mentioned type which can be adjusted to the dimensional characteristics of various fixtures and building situations when initially installed, and thus renders preliminary dimensional surveys superfluous and simplifies execution of the job.

A further object of the invention is to provide a boom arm or cantilever arrangement which can be assembled from a relatively small number of mass produced standard parts, thus simplifying storage inventory and reducing manufacturing costs.

Yet a further significant object of the present invention aims at providing a new and improved construction of a boom arm or cantilever arrangement of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the boom arm or cantilever arrangement of the present invention is manifested by the features that it is a swivelling elevator boom and body support assembly, comprising:

a hydraulic cylinder-and-piston elevator means having a substantially vertical axis of rotation;

a cantilever support arm having one end releasably fixed to and slideably adjustable in an upper free end of the piston of the elevator means by clamping screw means and having a horizontally extending longitudinal axis and a free outer end;

clamping means releasably fixed to and slideably and rotatably adjustable on the cantilever support arm;

a respective substantially vertical support arm mounted in each of the clamping means;

body support means mounted on the vertical support arm for accommodating a seated or reclining occupant; and a bar member mounted in the free outer end of the cantilever support arm to pivot about the longitudinal axis thereof and structured to form a handgrip and safety bar for retaining an occupant of the body support means and provided with guide groove means.

Each clamping means comprises, for instance, a quadrangular, for example substantially rectangular connecting or clamping block comprising the following features:

at least two clamping jaw portions of the block at least partially separated by a slot or gap extending, for instance, substantially parallel to a pair of mutually opposed faces of the block and defining mutually opposing inner faces of the clamping jaws and with each clamping jaw having at least one free end;

a major clamping or holding bore jointly formed on the mutually opposing inner faces and structured to accommodate the cantilever support arm and extending along an axis lying in the central plane of the slot or gap and substantially perpendicular to a further pair of mutually opposed faces of the clamping block; and fixation means, such as screw means acting at the free outer ends of the jaw portions to urge them toward one another.

At least one of the clamping means still further comprises at least one minor clamping or holding bore structured to accommodate the vertical support arm and having an axis extending substantially parallel or at any desired angular orientation with respect to the plane of the slot or gap.

The boom arm or cantilever arrangement of the present invention has the following advantages:

Since its design is releasable and adjustable, the boom arm or cantilever arrangement, even after installation, can be simply and quickly adapted to changed conditions, such as can arise from modifications to installations or to the building, changed methods of patient care and therapy and the varying ergonomic requirements of nursing and therapy personnel. A boom arm according to the invention has a flexibility of application which cannot be obtained with welded, custom-tailored constructions.

Furthermore, the basic elements of the design concept according to the invention, i.e. the horizontal support arm, the connecting pieces and the screw clamps, are correlated to their functions and not to the installation, that is they can be repeatedly employed in the same form independently of an individual installation.

The adaptation of a boom arm or cantilever arrangement to a particular installation is accomplished by dimensional adjustment during installation. The components and their means of connection therefore form an integral part of a modular or building block-like design. The same mass-produced standard-sized components can be used in a great number of varied installations. This results in the advantage of simplified production, materials procurement and parts supply.

The modular components according to the invention are so designed that they can be easily installed in situ and also readily disassembled again. They also have a relatively low weight. The boom arm or cantilever arrangement of the invention is therefore excellently suited to in situ assembly where difficult working conditions often prevail due to structural or other restrictions.

Any inadequacies of execution can later be easily corrected. It has furthermore proven advantageous that, due to the ready replaceability of the components, the maintenance of the boom arm and the corresponding training of maintenance personnel is greatly simplified. It is obvious that the improvements obtained with the invention, such as easy adaptability after installation, modular design, assembly in situ and simplified maintenance also lead to economic advantages - manufacturing costs of the boom arm are reduced, installation and maintenance costs are noticeably reduced and thus a generally economic solution is obtained.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various Figures of the drawings there have been generally used the same reference characters to denote the same or analogous components and wherein.

DETAILED DESCRIPTION OF THE PREFERRED EMBODIMENTS

Figure 1:
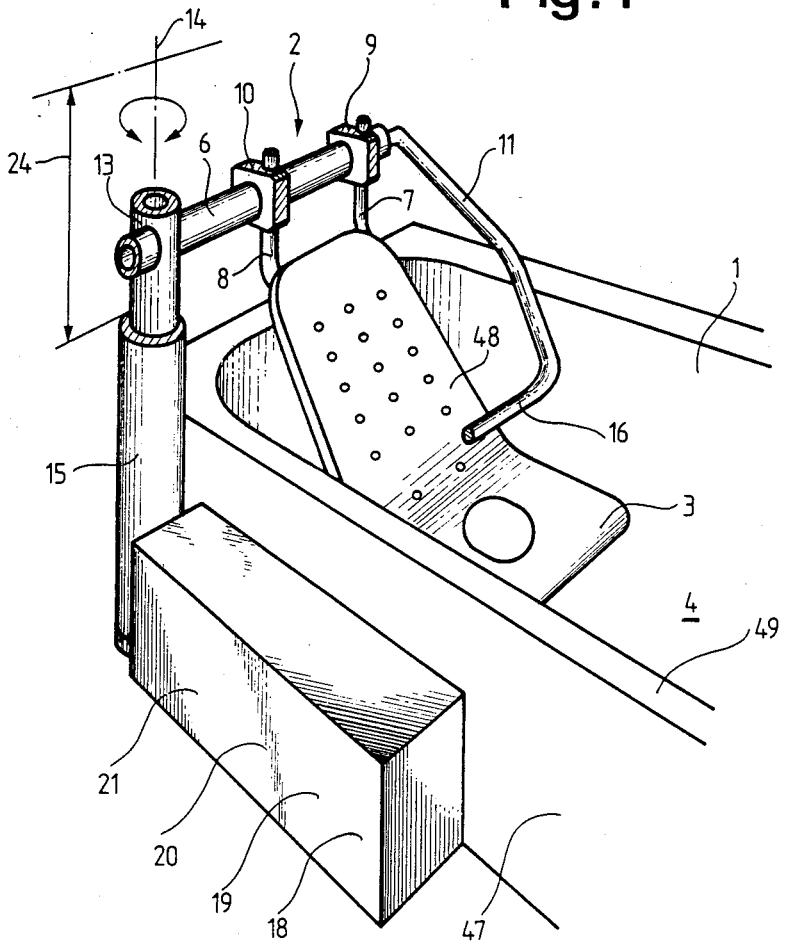
FIG. 1 is a schematic perspective view of a bathing installation with a boom arm or cantilever arrangement according to the invention showing the seat member or body support in its bathing or treatment position.

Describing now the drawings, it is to be understood that only enough of the construction of the boom arm or cantilever arrangement for the swivelling elevator boom and body support assembly has been shown as needed for those skilled in the art to readily understand the underlying principles and concepts thereof while simplifying the showing of the drawings. Turning attention now to FIG. 1, there is shown a tub or basin member 1 for built-in installation in which a bathtub seat or body support 3 supported by the boom arm or cantilever arrangement 2 is positioned in a bathing or therapy position 4. The boom arm 2 or cantilever arrangement, which will be explained later in greater detail in relation to FIG. 3, comprises a substantially horizontal cantilever support arm 6, the substantially vertical support arms 7, 8 for accommodating the bathtub seat 3, the connecting or clamping blocks 9, 10 for connecting the horizontal cantilever support arm 6 and the vertical support arms 7, 8, and a pivotable handgrip or retaining bar 11 which can be swung out of the way.

The horizontal cantilever support arm 6 is releasably fixed at one end to the piston rod or hydraulic ram 13 by the schematically indicated screw clamp means 12, which may be constituted, for instance, by at least one threaded bolt or screw extending through holes in the elastic upper ends 13*a* of the piston rod or ram 13. The boom arm or cantilever arrangement 2 therefore forms with the hydraulic cylinder 15 a swivelling elevator which can be raised or lowered along as well as rotated about the cylinder axis 14. A bar member structured to form a handgrip or safety bar 11 is pivoted to the other free or outer end 6*a* of the horizontal cantilever support arm 6. The free or outer end 6*a* of the horizontal cantilever support arm 6 may be conveniently provided with a not particularly visible bore for pivotably mounting the flexed end 11*a* of the handgrip or safety bar 11 and locking the same therein in any suitable manner, for instance with a bayonet-type locking action coacting with the guiding groove means 17. The pivotal mounting of the handgrip or safety bar 11 allows it to be swung out of the way and the guiding groove means 17 located at its mounting end serves to limit its motion. The safety bar 11 is provided with a handgrip or handle 16 at its other end. It will be understood that a tub body 1 or the like for exposed or free-standing installation can also be employed and a reclining body support member can be mounted on the vertical support members 7, 8 in place of the bathtub seat 3.

The hydraulic system 18 provided for the operation of the hydraulic elevator device comprises the merely schematically indicated conventional electric motor 19 and rotary vane pump 20. It is connected to the hydraulic cylinder 15 by a likewise schematically represented hydraulic conduit 21.

Figure 2:
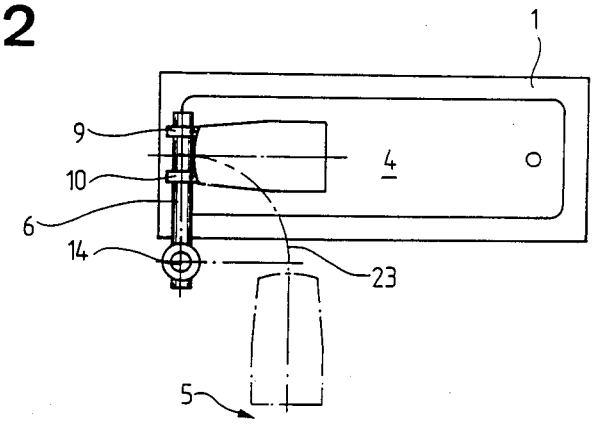
FIG. 2 is a schematic plan view of a bathing installation with the boom arm or cantilever arrangement according to the invention showing the seat member or body support in solid lines in the bathing or treatment position and showing it in broken lines in the loading or unloading position.

FIG. 2 shows the bathtub seat 3 in solid lines in the bathing or therapy position 4 within the tub member 1 and shows it in broken lines in the loading or entry position 5 outside of the tub member or body 1. As far as building conditions permit, all of the other positions of the bathtub seat 3 located on a cylindrical surface defined by an arc 23 about the cylinder axis 14 and by the cylinder stroke 24 are possible. Because the bathtub seat 3 is mounted on the horizontal cantilever support arm 6 by the quadrangular clamping or connecting blocks 9, 10 in slideably adjustable manner, the seat 3 can also be positioned at all spatial points within this cylindrical surface.

The mechanical and modular design concept, both of which are characteristic features of the present invention, will be described with reference to FIG. 3. Both of the substantially vertical support arms or arm members 7, 8 carrying the bathtub seat 3 are releasably and adjustably connected to the horizontal cantilever support arm or arm member 6 by means of the quadrangular clamping or connecting blocks 9 and 10. Each clamping block 9 and 10 is substantially divided into two clamping jaws 32 and 33 by a slot or gap 31 which lies substantially parallel to a pair of mutually opposed substantially parallel faces or surfaces 27 and 28 of the substantially quadrangular clamping blocks 9 and 10. These clamping jaws 32 and 33 are retained or urged toward one another at their free ends 36 by a schematically indicated screw clamping device 46 constituted, for instance, by a standard threaded bolt or screw, and at their fixed ends 37 they are rigidly connected with one another by a material web 38. It will be recognized that each clamping block has three pairs of parallel opposed faces of surfaces 25, 26 and 27, 28 and 29, 30.

Figure 3:
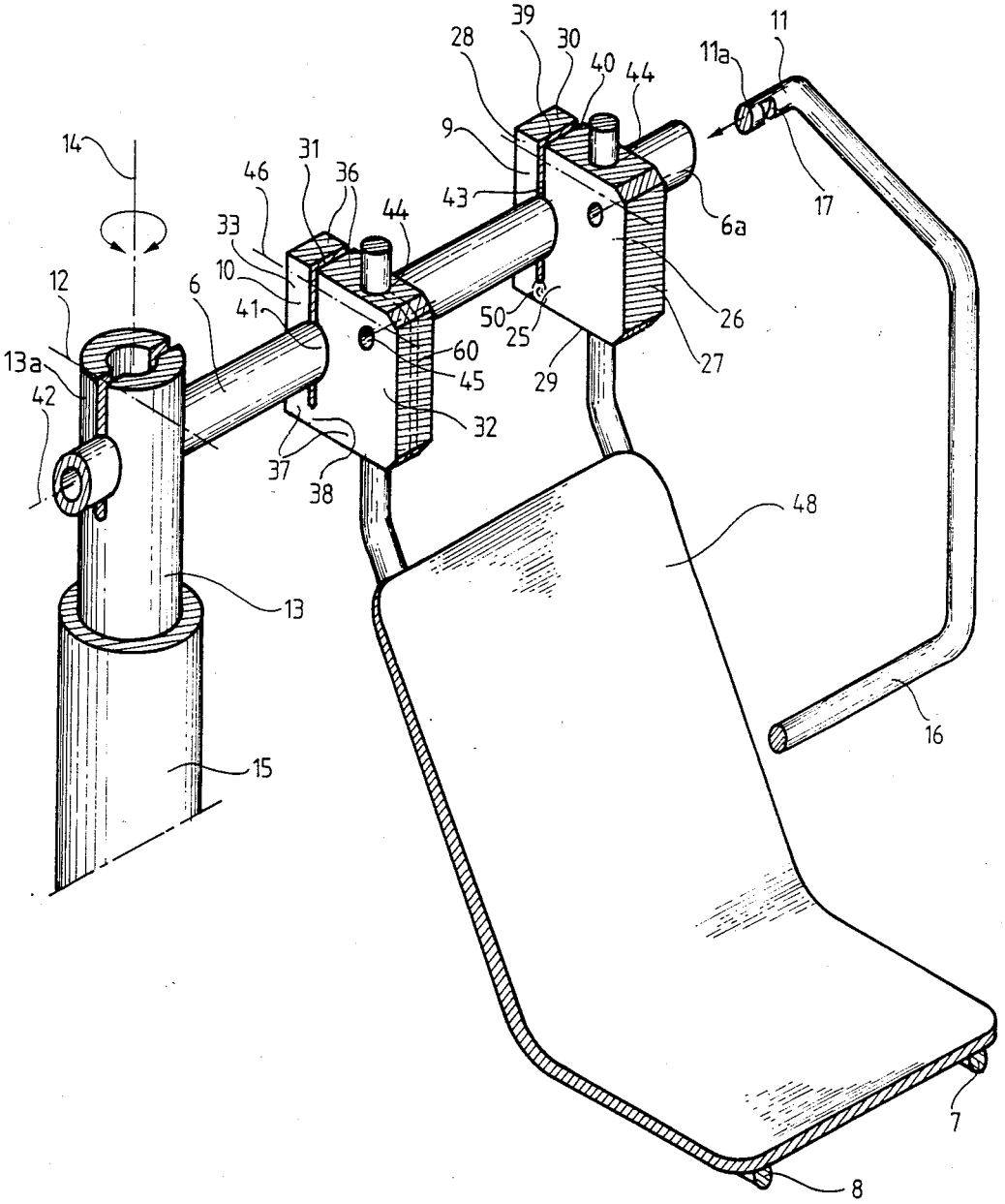
FIG. 3 is a schematic perspective view of the boom arm or cantilever arrangement according to the invention showing in greater detail its assembly to the swivelling elevator means.

The clamping jaws 32, 33 can also be connected in mutually pivoting relationship by a hinge in place of the material web 38, as the same has been generally indicated by reference character 50 for the clamping block 9 of FIG. 3. The inner surfaces or faces 39, 40 of the clamping jaws 32, 33 are provided with a major clamping bore 41 whose axis 42 lies in the plane of the slot or gap 43 and is substantially perpendicular to the pair of mutually opposed substantially parallel outer faces 25, 26 of the clamping blocks 9 and 10. When the clamping screws or screw clamps 46 are tightened, the inner faces 39, 40 surroundingly press against the horizontal cantilever support arm 6 and form a force transmitting connection between the latter and the support blocks 9, 10.

The support arms or rails 7, 8 are guided in minor clamping or support or retaining bores 44 substantially perpendicular to the major clamping bore 41 and substantially parallel to the slot or gap 43. They are retained in these minor bores 44 by the schematically indicated retaining pins 45 or equivalent fixation elements extending through receiving bores or holes of the clamping blocks 9 and 10, and are therefore held in fixed positional relationship to the clamping or connecting blocks 9, 10. For instance, the vertical support arms or rails 7 and 8 can each be provided with one or a number of not particularly visible continuous holes or bores through which the retaining pins 45 extend, or else there can be provided one or a number of grooves, for instance semicircular grooves or notches on the outer surface of these vertical support arms or rails 7 and 8 with which engage the retaining pins 45 extending through the aforementioned bores or holes provided in the related clamping block 9 or 10. It will be understood that this force-transmitting connection can also be effected by means of a screw clamping device, for instance, like the screw clamping devices previously described, in which case the faces or surfaces 26 of the clamping blocks 9 and 10 would be likewise provided with a respective vertically extending slot, generally indicated by reference character 60 for the clamping block 10, and which vertically extending slot or gap 60 is disposed substantially perpendicular to the previously described slot or gap 31. In a further embodiment, alternative or additional support or retaining bores 44 can also be provided in the clamping jaws 33 of the support blocks 9, 10 for accommodating the same or supplementary support arms 7, 8.

The horizontal cantilever support arm 6 is fixed to the upper end of the piston 13 by means of the screw clamp 12 and can therefore be raised and lowered in the hydraulic cylinder 15 along its axis 14 and can also be rotated about this axis. The bar member 11 is pivotably mounted at the other end of the horizontal cantilever arm 6 in such a manner that it can be swung or pivoted out of the way. As previously explained, this bar member 11 is structured to form the aforementioned handgrip or safety bar 16 and is provided with the guiding groove means 17 as a stop to limit the degree of its angular motion.

In order to further explain the functioning of the boom arm or cantilever arrangement 2 according to the invention in reference to the FIGS. 1, 2 and 3, it will be assumed that such boom arm 2 is to be adapted to a newly installed, narrower tub body 1 and that the bathing or therapy position is to be readjusted upward for ergonomic reasons.

Due to the narrower tub body 1, a narrower seating member 48 must be mounted on the substantially vertical support arms or rails 7, 8. To this end, the screw clamps 46 are released and the substantially quadrangular support blocks 9, 10 are slid towards one another until the substantially vertical support arms or rails 7, 8 are sufficiently close to permit the narrower seat member 48 to be mounted. Next the bathtub seat 3 is transferred to the bathtub 47 and the substantially rectangular clamping blocks 9, 10 are slid along the horizontal cantilever support arm 6 conjointly in mutually constant spaced relationship until the seat member 48 attains the desired position between the longitudinal walls of the bathtub in the lateral direction thereof. If the sliding motion of the support blocks 9, 10 along the horizontal cantilever support arm 6 does not suffice to position the seating member 48 laterally in the tub body 1, the horizontal cantilever support arm 6 can be slid in the piston rod 13 by releasing the clamping screw or screw clamp 12. This provides a further possibility of variation across the tub.

To position the seating member 48 in the longitudinal direction of the bathtub, a selection is made among differently formed vertical support arms 7, 8 as a first approximation. A second, finer adjustment is obtained by installing the vertical support arms 7, 8 in the support or retaining bores 44 of either the forward or the rear clamping jaws 32 or 33 of the clamping blocks 9, 10.

Still further adjustment can be effected by turning the substantially quadrangular clamping blocks 9, 10 about the horizontal cantilever support arm 6 to change the angular position of the seat member 48 with respect to the vertical so that the seat back extends substantially parallel to the slope of the associated bathtub end. After the seat member 48 has been adapted to the new tub body 1 in the lateral and longitudinal directions as well as in its angular position, the adjusted position is fixed by tightening the screw clamps 12 and 46.

When treating patients, therapy personnel must have the possibility of assuming an ergonomically optimal working posture. In this respect, in addition to the previously mentioned possibility of sliding the bathtub seat 3 laterally, longitudinally and diagonally with respect to the bathtub 47, its adjustability in the vertical direction is also significant. In the boom arm or cantilever arrangement 2 according to the invention, this is provided in two ways. In addition to the hydraulic height adjustment of the boom arm 2, the bathtub seat 3 can also be adjusted in height relative to the boom arm 2 by sliding the vertical support arms 7, 8 within the support or minor retaining bores or apertures 44.

To transport a patient into the bathtub 47, the bathtub seat 3 is positioned in the loading or entry position 5 outside of the tub body 1 where the patient can be safely and comfortably placed on the seating member 48. The seat and the patient can then be hydraulically elevated above the edge flange or ring 49 of the tub body 1 to permit an unhindered swivelling motion in the region above the bathtub 47. When the hydraulic pressure is diminished, the bathtub seat 3 automatically descends into the lower limit or terminal position in the tub body 1 defined by the vertical adjustment of the vertical support arms 7, 8 in the support or retaining bores 44 as the therapeutically and ergonomically correct bathing position 4. The transport of the patient out of the bathing position 4 into the exit or unloading position 5 proceeds in analogous manner. Both transfers take place without danger, since the patient is protected from falling out of the seat by the handgrip or safety bar 11.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A swivelling elevator boom and body support assembly, particularly for bathtub seating devices and the like, comprising:

rotatable elevator means having a free upper end;

a cantilever support arm having a longitudinal axis extending substantially horizontally, a mounting end and a free end;

means for securing said mounting end to said free upper end of said elevator means;

at least one substantially vertical support arm for carrying a body support means for accommodating a seated or reclining occupant;

clamping means releasably and adjustably connecting said at least one substantially vertical support arm to said cantilever support arm;

said clamping means comprising at least one substantially quadrangular block;

said at least one quadrangular block further comprising:

two clamping jaw portions having mutually opposing inner faces disposed substantially parallel to a first pair of mutually opposing outer faces of the quadrangular block;

each clamping jaw portion having at least one free end;

a gap defined by said mutually opposing inner faces;

a clamping bore formed at said inner faces and having an axis lying substantially in a central plane of said gap and extending substantially perpendicular to a second pair of mutually opposing outer faces of the quadrangular block and receiving therein said cantilever support arm;

screw clamping means restraining said free end of each of the two clamping jaw portions;

at least said one quadrangular block further comprising;

at least one retaining bore oriented in a predetermined position relative to said gap and receiving therein said at least one vertical support arm; and a handgrip and safety bar member mounted in said free end of the cantilever support arm to perform a pivoting motion about said longitudinal axis away from the body support means and provided with groove means for limiting said pivoting motion.

2. The swivelling elevator boom and body support assembly as defined in claim 1, further including:

means for releasably and adjustably mounting said at least one vertical support arm in said clamping means defined by said quadrangular block.

3. The swivelling elevator boom and body support assembly as defined in claim 2, wherein:

said means for releasably and adjustably mounting said at least one vertical support arm comprise retaining pin means.

4. The swivelling elevator boom and body support assembly as defined in claim 2, wherein:

said means for releasably and adjustably mounting said at least one vertical support arm comprise screw clamping means.

5. The swivelling boom and body support assembly as defined in claim 1, wherein:

said retaining bore is disposed in said clamping means defined by said quadrangular block in unequal perpendicular distance from said central plane of said gap.

6. The swivelling boom and body support assembly as defined in claim 1, wherein:

said retaining bore is disposed in said clamping means defined by said quadrangular block in substantially parallel relationship to said clamping bore.

7. The swivelling boom and body support assembly as defined in claim 1, wherein:

said retaining bore is disposed in said clamping means defined by said quadrangular block in any desired angular relationship to said clamping bore.

8. The swivelling elevator boom and body support assembly as defined in claim 1, wherein:

each of said two clamping jaw portions has a restrained end; and hinge means for uniting said two clamping jaw portions at said restrained ends.

9. The swivelling elevator boom and body support assembly as defined in claim 1, wherein:

two of said clamping means each comprising a respective one of said quadrangular blocks is provided; and each said clamping means supporting a respective one of said vertical support arms.

10. A swivelling elevator boom and body support assembly, particularly for bathtub seating devices and the like, comprising:

rotatable elevator means having an upper end region;

a cantilever support arm having a longitudinal axis extending substantially horizontally and a mounting end region;

means for securing said mounting end region to said upper end region of said elevator means;

at least one support arm carrying a body support means for accommodating a seated or reclining occupant;

clamping means releasably and adjustably connecting said at least one support arm to said cantilever support arm;

said clamping means comprising at least one block member;

said at least one block member further comprising:

two clamping jaw portions having mutually opposing inner faces defining a gap therebetween;

each said clamping jaw portion having at least one free end and a connecting end;

said two clamping jaw portions being interconnected at their connecting ends in an unreleasable manner during normal operation of the swivelling elevator boom and body support assembly;

a clamping bore formed jointly at said inner faces and having an axis lying substantially in a plane of said gap;

said clamping bore accommodating said cantilever support arm;

a screw clamping device for restraining said free ends of the two clamping jaw portions;

said at least one block member further comprising at least one retaining bore accommodating said at least one support arm;

said at least one retaining bore extending through at least one of said two clamping jaw portions substantially perpendicular to said clamping bore; and fixation elements operatively associated with said at least one retaining bore and retaining said at least one support arm in an adjustable fixed positional relationship with respect to said at least one block member.

* * * * *

UNITED STATES PATENT AND TRADEMARK OFFICE

CERTIFICATE OF CORRECTION

PATENT NO. : 4,569,091

DATED : February 11, 1986

INVENTOR(S) : KURT BRANDENBERGER

It is certified that error appears in the above—identified patent and that said Letters Patent is hereby corrected as shown below:

Please delete claim 10 in its entirity.

Signed and Sealed this

*Twentieth* Day of *May 1986*

[SEAL]

*Attest:*

DONALD J. QUIGG

*Attesting Officer*

*Commissioner of Patents and Trademarks*